US010066885B2

(12) United States Patent
Chen

(10) Patent No.: US 10,066,885 B2
(45) Date of Patent: Sep. 4, 2018

(54) MAGAZINE WELL FUNNEL ASSEMBLY

(71) Applicant: Legacy Custom Products, Inc., Durango, CO (US)

(72) Inventor: Stan Chen, Durango, CO (US)

(73) Assignee: Legacy Custom Products, Inc., Durango, CO (US)

( * ) Notice: Subject to any disclaimer, the term of this patent is extended or adjusted under 35 U.S.C. 154(b) by 0 days.

(21) Appl. No.: 15/410,514

(22) Filed: Jan. 19, 2017

(65) Prior Publication Data

US 2017/0205168 A1 Jul. 20, 2017

Related U.S. Application Data

(60) Provisional application No. 62/280,626, filed on Jan. 19, 2016.

(51) Int. Cl.

| | |
|---|---|
| ***F41A 23/10*** | (2006.01) |
| ***F41A 35/00*** | (2006.01) |
| ***F41C 27/00*** | (2006.01) |
| ***F41A 9/65*** | (2006.01) |
| ***F41C 23/10*** | (2006.01) |
| ***F41A 9/59*** | (2006.01) |

(52) U.S. Cl.

CPC ..... *F41A 9/65* (2013.01); *F41A 9/59* (2013.01); *F41A 35/00* (2013.01); *F41C 23/10* (2013.01)

(58) Field of Classification Search

CPC ..... F41A 9/24; F41A 9/28; F41A 9/54; F41A 9/55; F41A 35/00; F41C 23/10; F41C 27/00

See application file for complete search history.

(56) References Cited

U.S. PATENT DOCUMENTS 3,999,321 A * 12/1976 Musgrave ..... F41C 23/10 42/1.01
4,520,585 A * 6/1985 Barrett ..... F41C 23/10 42/7
4,570,370 A * 2/1986 Smith ..... F41C 23/10 42/7
5,052,140 A * 10/1991 Smith ..... F41C 23/10 42/7

(Continued)

OTHER PUBLICATIONS

Chen Magwell Suiter™, as retrieved from the Wayback Machine website on Dec. 13, 2015.

*Primary Examiner* — Derrick R Morgan
(74) *Attorney, Agent, or Firm* — Sanderson IP Law, Ltd.

(57) ABSTRACT

A magazine well funnel assembly is an integrated design including a mainspring housing portion and a funnel well portion attached to a firearm. The magazine well funnel assembly includes a set of funnel walls arranged to form an aperture shaped to accept a magazine and is bounded by a funnel rim on a side of the set of funnel walls opposite a plane of the aperture. The funnel rim is shaped in an arc on a side of the set of funnel walls adjacent to the rear funnel wall portion to increase the surface area of the funnel. A method of modification includes drilling a relocated pin hole in the firearm frame and inserting the magazine well funnel assembly therein. A base section of the firearm frame may be removed to preserve the same vertical length of the firearm compared to before the magazine well funnel assembly was installed.

5 Claims, 10 Drawing Sheets

(56) References Cited

U.S. PATENT DOCUMENTS

| | | | | |
|---|---|---|---|---|
| 5,621,995 | A * | 4/1997 | Smith | F41A 9/65<br>42/50 |
| 5,761,842 | A * | 6/1998 | Mantymaa | F41C 23/12<br>42/71.02 |
| 7,743,542 | B1 * | 6/2010 | Novak | F41C 23/10<br>42/49.02 |
| 2008/0163531 | A1 * | 7/2008 | Zukowski | F41A 17/46<br>42/21 |
| 2010/0132238 | A1 * | 6/2010 | Werner | F41C 23/10<br>42/71.02 |
| 2013/0139426 | A1 * | 6/2013 | Baxley | F41C 23/10<br>42/71.02 |
| 2017/0205188 | A1 * | 7/2017 | Chavez | F41C 23/10 |
| 2017/0356710 | A1 * | 12/2017 | Full | F41C 3/00 |

* cited by examiner

MAGAZINE WELL FUNNEL ASSEMBLY

CROSS-REFERENCE TO RELATED APPLICATION

This application claims the benefit of the filing date of U.S. provisional patent application Ser. No. 62/280,626, filed on Jan. 19, 2016, the disclosure of which is incorporated herein by reference.

BACKGROUND

Firearms typically have a square edge along a magazine well entrance where a shooter can insert a new magazine when the shooter wishes to reload the firearm. Under stressful conditions, a shooter may need to load the firearm rapidly such as in competition, defensive, or tactical use of the firearm. Under these conditions, inserting a new magazine into a firearm with a square edge along the magazine well entrance can be too slow and ineffective because the shooter must precisely align the new magazine with the entrance of the firearm's magazine well to successfully insert the new magazine. Additionally, firearm magazines may include a magazine lip to facilitate removal of the magazine from a firearm, such as when the magazine becomes stuck inside the firearm. If the shooter cannot access, or can only partially access, the magazine lip, it may delay or prohibit removal of the magazine from the firearm.

SUMMARY

In implementations described herein, a magazine well funnel assembly includes a set of funnel walls including a plurality of funnel wall portions arranged to form an aperture shaped to accept a magazine. The set of funnel walls are further bounded by a funnel rim on a side of the set of funnel walls opposite a plane of the aperture, wherein one of the plurality of the funnel wall portions forms a different angle with a plane of the aperture than another of the plurality of the funnel wall portions. Varying the angles of the funnel wall portions with respect to the plane of the aperture increase the surface area of the funnel. Increased surface area of the magazine well funnel improves guidance of a magazine into the firearm. A shooter therefore does not need to align a new magazine precisely with the aperture to load it into the firearm.

In other implementations described herein, a magazine well funnel assembly having a set of funnel walls arranged to form an aperture and bounded by a funnel rim is attached to the frame of a firearm configured to accept a magazine. The funnel rim includes a recessed magazine lip support surface disposed adjacent to a magazine lip access notch in the magazine well funnel assembly. The magazine access notch provides the shooter access to a magazine that has become stuck inside the firearm.

Other implementations described herein include modifying a firearm by obtaining a firearm having a frame, drilling a relocated frame pin hole on the frame of the firearm, inserting a magazine well funnel assembly into the frame of the firearm, and inserting a pin into the relocated frame pin hole and the mainspring housing body pin hole. The obtaining step optionally includes removing a base section from the frame of the firearm, which preserves the length of the firearm after a magazine well funnel assembly is installed.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Other implementations are also described and recited herein.

BRIEF DESCRIPTION OF THE DRAWINGS

A further understanding of the nature and advantages of the present technology may be realized by reference to the figures, which are described in the remaining portion of the specification.

DETAILED DESCRIPTIONS

Figure 1:
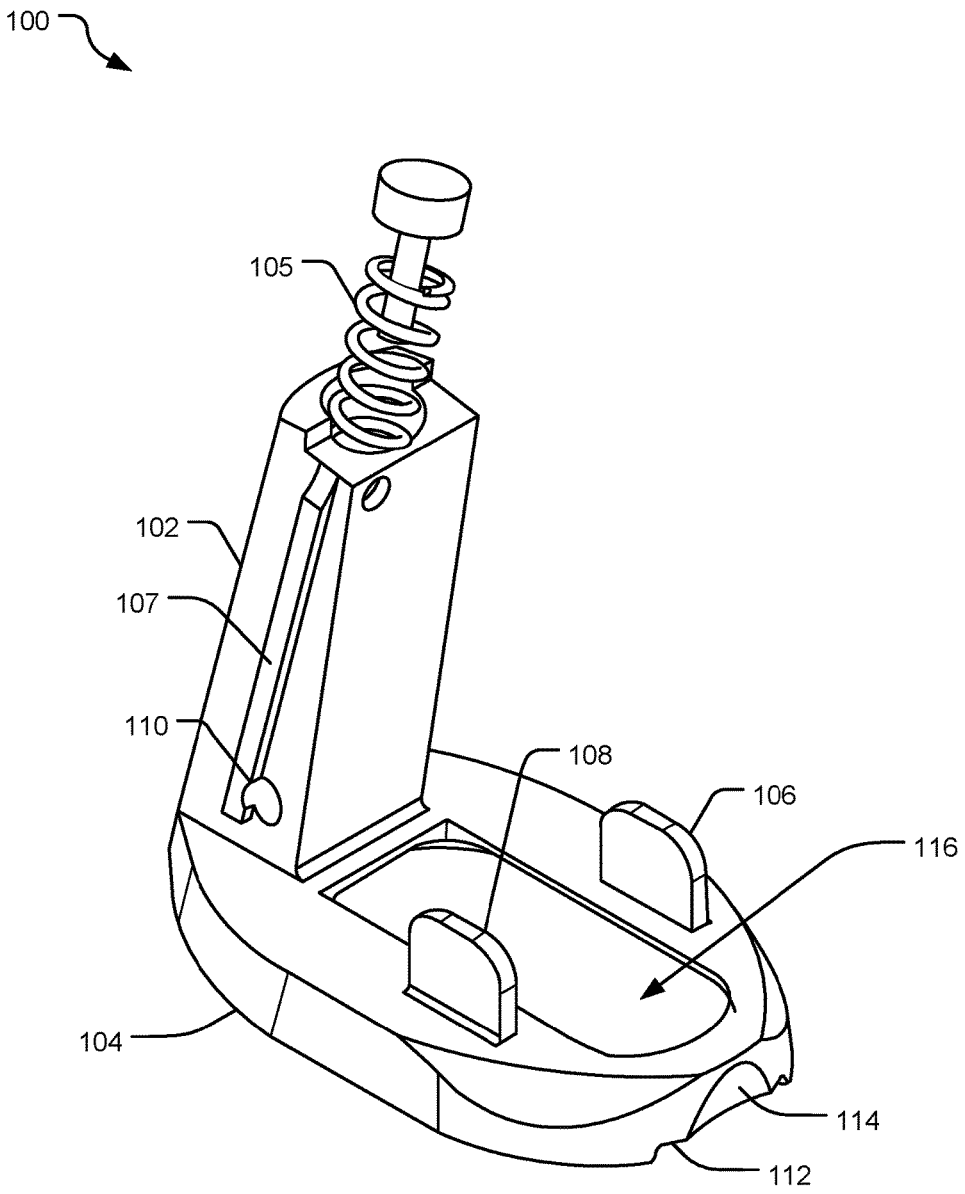
FIG. 1 is an isometric view of an example magazine funnel well assembly from the top left.

FIG. 1 is an isometric view of an example magazine funnel well assembly 100 from the top left. The magazine well funnel assembly includes two main components, a mainspring housing body 102 and a magazine well funnel portion 104. The mainspring housing body 102 includes a cavity for the mainspring 106 for a firearm, typically a spiral torsion spring of metal ribbon for actuating a hammer when a shooter pulls the trigger of the firearm. The mainspring housing body 102 is slidably insertable into the magazine well of a firearm frame along side rail 107 and fixably attached thereto via a pin inserted into a pinhole on the firearm frame aligned with pinhole 110 on the mainspring housing. The back of the mainspring housing is in contact with the palm of the shooter's hand when holding the firearm, and may include a rough texture pattern to improve grip on the firearm. The magazine well funnel portion includes a set of walls for guiding the magazine into the magazine well such that a shooter does not need to precisely align the magazine with the opening in the magazine well.

The magazine well funnel assembly is an integrated design wherein the mainspring housing body 102 is attached to the magazine well funnel portion 104. In one implementation, the mainspring housing body 102 and the funnel portion 104 may be manufactured as distinct pieces and attached together (e.g., via bolting, welding, dovetailing, pinning, with a keyway, gluing, etc.). Alternatively, the mainspring housing body 102 and the magazine well funnel portion 104 may be produced as a one-piece design machined out of a single piece of material. The integrated design may allow for simple installation of the part. With an integrated design, installation does not require welding, tapping, or complicated machining to install the magazine well funnel assembly into the firearm. The integrated design also allows for a greater overall area of the funnel portion of the magazine well funnel assembly, and especially a larger rear funnel wall, due to relocation of the mainspring pin, which does not interfere with the enlarged funnel portion as explained in more detail below.

In at least one implementation, the magazine well funnel assembly 100 includes reinforcement tabs 106 and 108 to provide stability when inserted into the firearm frame. The reinforcement tabs 106 and 108 are disposed on an upper surface of the funnel portion 104 of the magazine well funnel assembly 100. The reinforcement tabs 106 and 108 maintain operability of the firearm in the event the magazine well funnel assembly is struck hard from the side. The interior surface of each reinforcement tab 106 and 108 contacts the corresponding exterior surface of the firearm frame, and, if the firearm is struck from the side during hard use, the reinforcement tabs 106 and 108 prevent the funnel portion 104 from twisting sideways or dislodging. The funnel portion 104 includes a set of funnel walls arranged to form an aperture 116 shaped to accept a magazine into the firearm via the funnel portion 104. In another implementation, the magazine well funnel portion includes a magazine lip access notch 114 and a magazine lip support surface 112 as described in more detail below.

Figure 2:
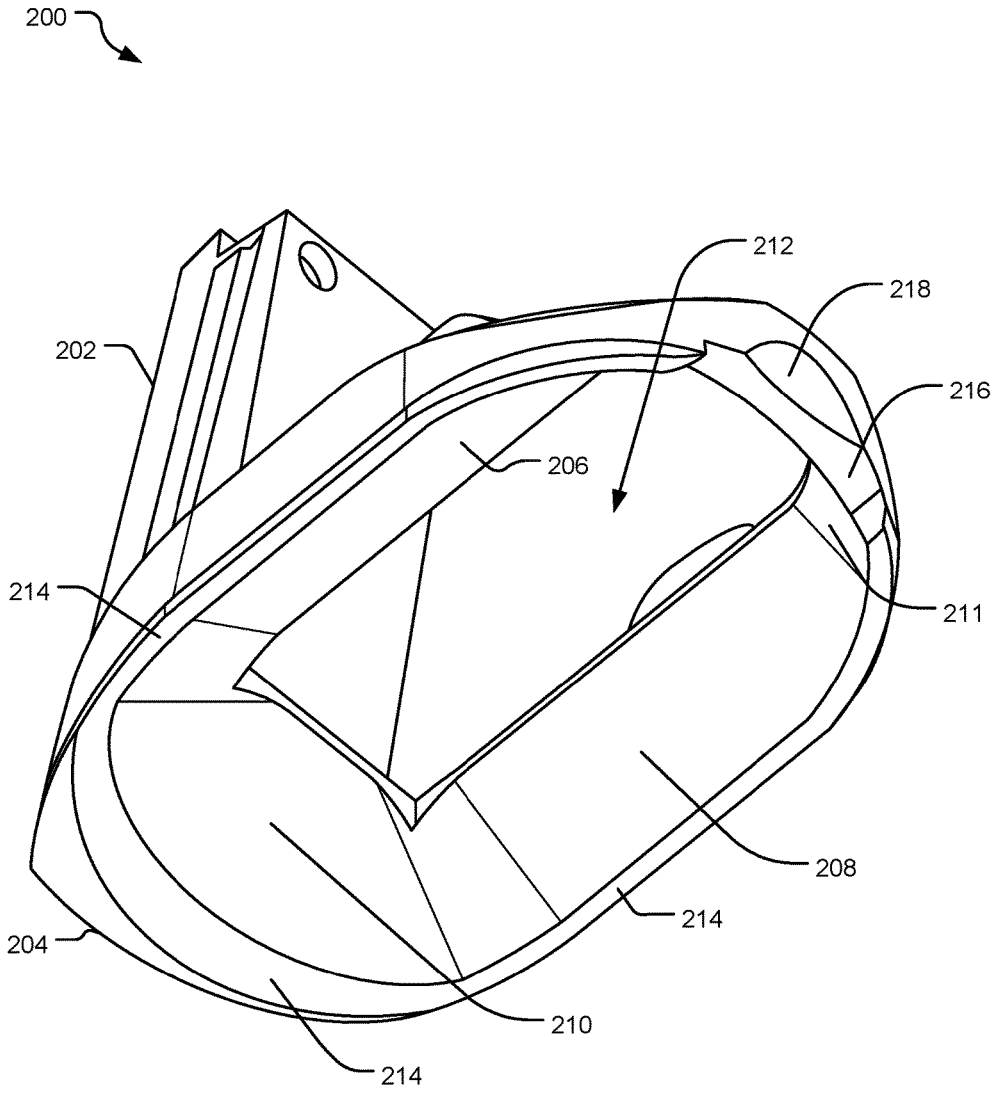
FIG. 2 is an isometric view of an example magazine well funnel assembly from the lower left.

FIG. 2 is an isometric view of an example magazine well funnel assembly 200 from the lower left. The magazine well funnel assembly 200 includes a mainspring housing portion 202 attached to a magazine well funnel portion 204. The magazine well funnel portion 204 includes a set of funnel walls. In one implementation, the set of funnel walls includes a first lateral funnel wall portion 206, a second lateral funnel wall portion 208, a front funnel wall portion 211, and a rear funnel wall portion 210. Together, the set of funnel walls define a funnel to guide a magazine into the magazine well of the firearm.

The set of funnel walls are arranged to form an aperture 212 in the magazine well funnel assembly. The aperture 212 is sized to match the dimensions of a magazine, and the interior dimensions of the firearm's magazine well, and thus may accept a standard sized magazine. In one implementation, the standard sized magazine is a magazine compatible with an M1911 firearm. The aperture may be sized according to the type of magazine compatible with the firearm on which the magazine well funnel assembly is installed.

The set of funnel walls are bounded by a funnel rim 214 on a side of the set of funnel walls opposite the aperture. In an implementation, the funnel rim is a flat surface disposed at substantially the same angle as the plane of the aperture. The funnel rim may have a thin width, such as a width of approximately 0.060 inches. A rear portion of the funnel rim 214 may be formed in the shape of an arc at a boundary between the funnel rim 214 and the rear funnel wall portion 210. Shaping the funnel rim 214 in an arc may increase the area of the rear funnel wall 210 and thus improve the performance of the funnel (e.g., to allow the funnel to guide a magazine into the aperture that is less precisely aligned with the aperture by the shooter). The integrated design of the magazine well funnel assembly 200 allows forming the funnel rim 214 in a larger arc than would be possible in a non-integrated design due to the relocation of structure attaching the magazine well funnel assembly 200 to the firearm frame. In one implementation, the magazine well funnel assembly is an integrated design and the rear portion of the funnel rim is in the shape of an arc of substantially 132 degrees with a radius of substantially 0.590 inches. Other dimensions of the rear portion of the funnel rim are also disclosed herein including an arc of 20 up to 180 degrees and a radius of between 0.20 to 2.0 inches.

In one implementation, one or more walls in the set of funnel walls is substantially flat and arranged at an angle with respect to a plane of the aperture. In another implementation, one or more walls in the set of funnel walls have a substantially flat upper portion arranged at an angle with respect to the plane of the aperture and a sloping lower portion arranged at a greater angle with respect to the plane of the aperture. The sloping lower portion of the funnel walls may be joined to the frame of the firearm by machining the sloping lower portion of the funnel wall up to the junction with the firearm frame. As used herein, the "angle" of a funnel wall with respect to the plane of the aperture refers to the angle of the substantially flat portion of the funnel wall, which may encompass part or all of the funnel wall portion.

The angles of each of the funnel walls with respect to the plane of the aperture may differ from one another. For example, without limitation, the angle of the first lateral funnel wall portion 206 and the second lateral funnel wall portion 208 with respect to the plane of the aperture may be equal to one another, but greater than the angle of the rear funnel wall portion 210 with respect to the aperture 212. Likewise, the angle of the front funnel wall portion 211 with respect to the aperture 212 may be greater than the angle of the first lateral funnel wall portion 206 and second lateral funnel wall portion 208 with respect to the aperture 212. Other relative angles, or combinations of angles, of the funnel wall portions with respect to the aperture 212 may also be used. In one implementation, the rear funnel wall portion 210 is at a lower angle with respect to the aperture than the angles of the other funnel wall portions such that the rear funnel wall portion 210 extends to the funnel rim 214.

The large contour of the set of magazine walls guides a magazine towards the cavity in the center when a shooter inserts a magazine into the firearm frame. A lower angle of the rear funnel wall portion 210 with respect to the aperture 212 increases the area of the funnel, and thus increase performance of the funnel (e.g., to allow the funnel to guide a magazine into the aperture that is less precisely aligned with the aperture by the shooter). The set of funnel walls allow for a greatly enlarged area to guide the magazine into the firearm frame during reloading, when compared to a firearm without a magazine well funnel assembly. The shooter simply has to insert the magazine anywhere within the perimeter of the funnel portion, and the set of funnel walls guides the magazine into the firearm's magazine well. The magazine well funnel assembly dramatically increases the margin of error in aligning the magazine with the magazine well of the firearm. The funnel formed by funnel wall portions 206, 208, 210, and 211 is large in interior surface area, however, externally, the funnel outer dimensions may not exceed the width of the firearm with grips installed.

In one implementation, the funnel wall portions of the set of funnel walls are each a flat surface joined together by a fillet at the junctions between the respective funnel wall portions. In another implementation, the surfaces of the funnel wall portions of the set of funnel walls are curved and form smooth intersections with one another. In yet another implementation, the funnel wall portions of the set of funnel walls are each a flat surface that meet one another at seams.

The magazine well funnel assembly 200 includes a magazine lip support surface 216 and a magazine lip access notch 218. The magazine lip support surface 216 is sized such that the lip of a magazine compatible with the firearm on which the magazine well funnel assembly 200 is installed rests on the magazine lip support surface 216. The magazine lip support surface 216 therefore provides an additional point of contact between the magazine and the magazine well funnel assembly 200 to improve stability and feel of the magazine when fully inserted into the firearm. The magazine lip support surface 216 also limits the upward travel of a magazine into the firearm frame, thus preventing damage to the firearm and reducing the probability of a stuck magazine. In one implementation, the magazine lip support surface 216 is recessed in the funnel rim 214 as shown in FIG. 2. In another implementation, the magazine lip support surface 216 is flush with the funnel rim 214. In yet another implementation, the magazine lip support surface 216 is disposed below the funnel rim 214.

One of the functions of a magazine lip is to facilitate removal of the magazine from the firearm by the shooter (e.g., if the magazine becomes stuck inside the firearm due to damage to the magazine or firearm or accumulation of debris within the firearm). A stuck magazine causes the firearm to become inoperable, which can lead to dire consequences if the firearm is being used in a life or death situation. A shooter may press downward on the magazine lip to separate the magazine from the firearm and to free the magazine well to accept another magazine. To preserve access to the magazine lip, the magazine well funnel assembly includes a magazine lip access notch 218. The magazine lip access notch 218 is a radiused notch formed directly above the magazine lip support surface 216 on the front of the magazine well funnel assembly such that the magazine lip of a magazine inserted into the firearm can be reached via the magazine lip access notch 218 (e.g., by a shooter's fingertip, the floorplate or basepad of a spare magazine, or any object having a flat, rigid surface of appropriate size to fit in the magazine access notch 218, etc.) when the magazine lip is resting against the magazine lip support surface 216.

Figure 3:
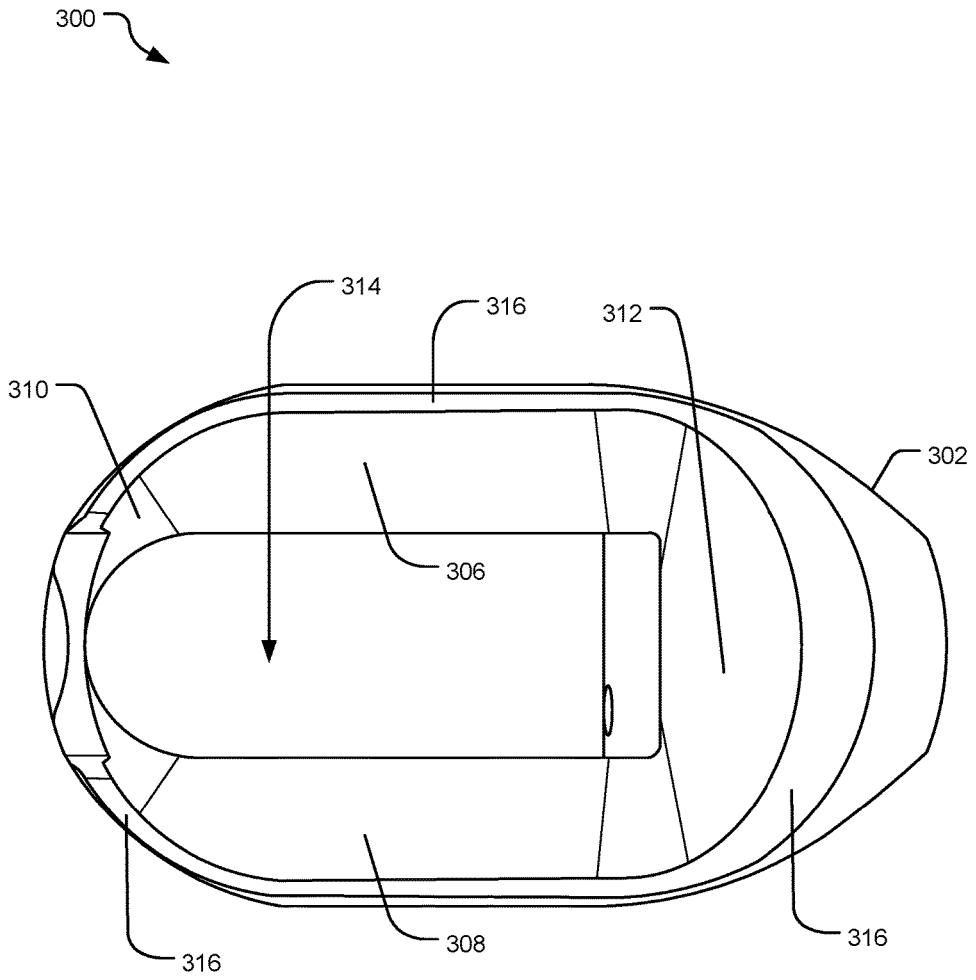
FIG. 3 is a plan view of an example magazine well funnel assembly from the bottom.

FIG. 3 is a plan view of an example magazine well funnel assembly 300 from the bottom. The magazine well funnel assembly 300 includes a magazine well portion 302 and a set of funnel walls including a first lateral side funnel wall portion 306, a second lateral side funnel wall portion 308, a front funnel wall portion 310, and a rear funnel wall portion 312. The set of funnel walls are arranged to form an aperture 314 shaped to accept a magazine. The set of funnel walls are further bounded by a funnel rim 316.

The set of funnel walls define a funnel area. It is apparent in the bottom view that the funnel area occupies the majority of available space available in the magazine well funnel assembly 300. As such, a magazine that is not precisely aligned with the aperture will be guided into the aperture from a variety of points in the funnel area.

Figure 4:
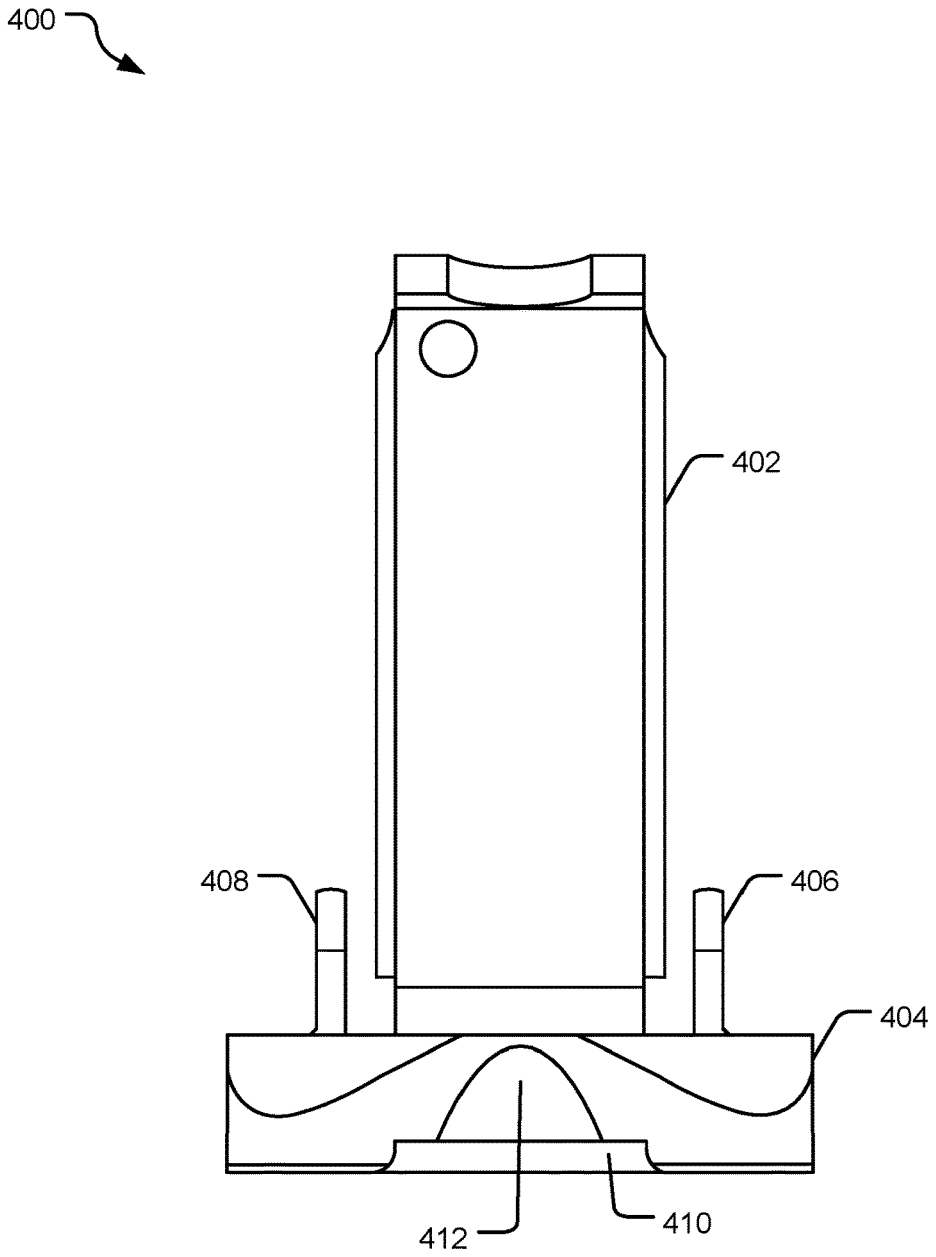
FIG. 4 is an elevation view of an example magazine well funnel assembly from the front.

FIG. 4 is an elevation view of an example magazine well funnel assembly 400 from the front. The magazine well funnel assembly includes a mainspring housing portion 402 and a funnel portion 404. The magazine well funnel assembly 400 includes reinforcement tabs 406 and 408 to provide stability for the magazine well funnel assembly 400 inside the frame of a firearm and to increase durability and operability of the firearm if it is struck hard from the side. The magazine well funnel assembly 400 includes a magazine lip support surface 410 and a magazine lip access notch 412 disposed adjacent thereto.

Figure 5:
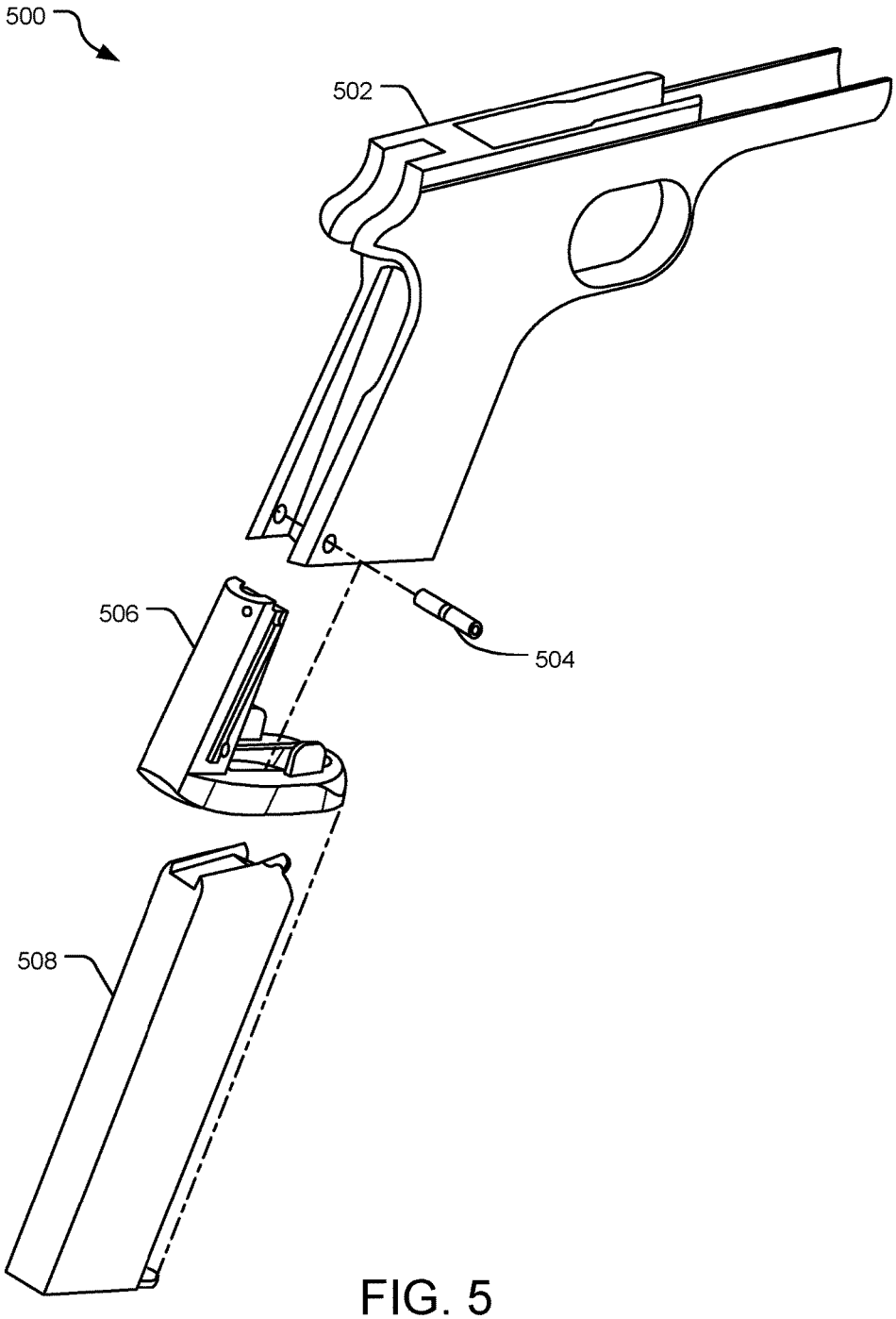
FIG. 5 is a perspective exploded view of a firearm frame, a mainspring housing pin, an example magazine well funnel assembly, and a magazine.

FIG. 5 is a perspective exploded view 500 of a firearm frame 502, a mainspring housing pin 504, an example magazine well funnel assembly 506, and a magazine 508. The magazine well funnel assembly 506 slides within the firearm frame 502 and is secured thereto via the mainspring housing pin 504. The firearm frame 502 accepts magazine 508 into a magazine well portion of the firearm frame 502 via an aperture in the magazine well funnel assembly 506.

Figure 6:
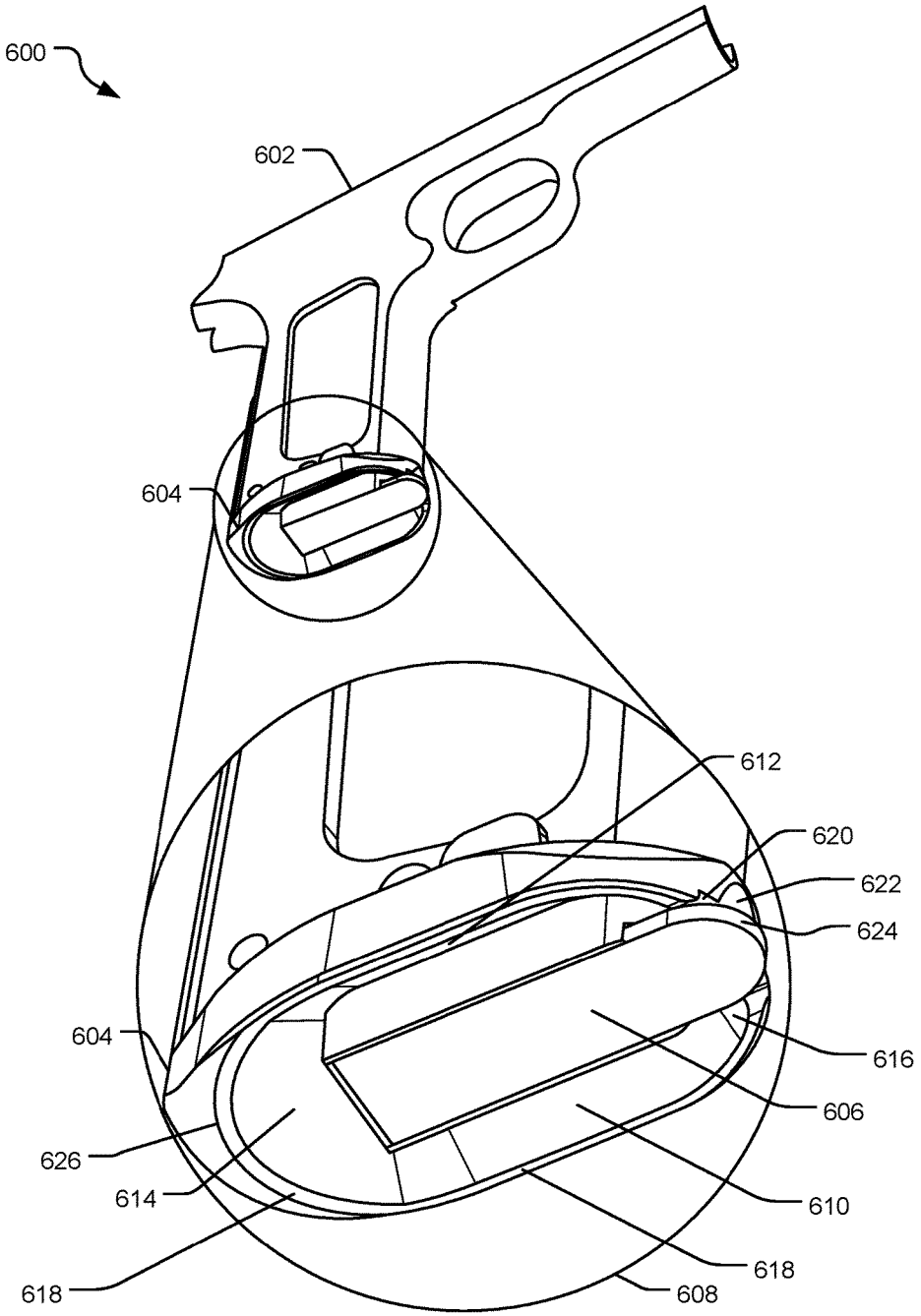
FIG. 6 is a perspective view from below showing a firearm with an example magazine well funnel assembly with a magazine inserted and an expanded perspective view from below of the base of a firearm frame and example magazine well funnel with a magazine inserted.

FIG. 6 is a perspective view 600 from below showing a firearm 602 with an example installed magazine well funnel assembly with a funnel portion 604 with an magazine 606 inserted therein. FIG. 6 includes an expanded perspective view 608 from below of the base of the firearm 602 and funnel portion 604 with a magazine 606 inserted. The funnel portion 604 includes a set of funnel walls including at least first lateral funnel wall portion 610, a second lateral funnel wall portion 612, a rear funnel wall portion 614, and a front funnel wall portion 616. The set of funnel walls are arranged to form an aperture to accept the magazine 606, and are bounded by a funnel rim 618 on a side of the set of funnel walls opposite the aperture.

The funnel portion 604 of the magazine well funnel assembly includes a magazine lip support surface 620 and a magazine lip access notch 622 disposed adjacent thereto. When the magazine 606 is fully inserted into the firearm 602 via the aperture in the magazine well funnel portion 604, the lip 624 of the magazine 606 rests against the magazine lip support surface 620. The magazine lip support surface 620 provides an additional point of contact between the magazine 606 and the firearm 602, thus improving fit and stability of the magazine 606 and prevents the magazine 606 from being inserted too far inside the firearm, which could cause damage to the firearm 602 or could cause the magazine 606 to become stuck inside the firearm 602. In an implementation, the magazine lip support surface 620 is a recessed surface in the funnel rim 618. In another implementation, the magazine lip support surface 620 is not part of the funnel rim 618. For example, without limitation, the magazine lip support surface 620 may be substantially 0.070 inches below the funnel rim 612. In another implementation, the magazine lip support surface is disposed above the funnel rim.

Each of the plurality of funnel wall portions 610, 612, 614, and 616 form an angle with a plane of the aperture. Decreasing the angle of the respective funnel wall portions with the plane of the aperture increases the area of the funnel defined by the funnel wall portions 610, 612, 614, and 616. An increased funnel area improves the likelihood that a shooter will be able to successfully insert magazine 606 into the aperture without precisely aligning the magazine 606 with the aperture. In an implementation, the angle of the rear funnel wall portion 614 with the plane of the aperture is less than the angles of the other funnel wall portions with the plane of the aperture. In another implementation, the first lateral funnel wall portion 610 and the second lateral funnel wall portion 612 each form the same angle with the plane of the aperture.

One way to increase the area of the funnel defined by the respective funnel wall portions of the set of funnel walls is for the rear funnel wall portion 614 to extend from the aperture to the funnel rim 618. Another way to increase the area of the funnel defined by the respective funnel wall portions is for the funnel rim 618 to curve in an arc 626 away from the aperture. In an implementation, the funnel rim 618 is in the shape of an arc 626 of substantially 132 degrees and 0.590 inch radius. Other dimensions of the rear portion of the funnel rim are also disclosed herein including an arc of 20 up to 180 degrees and a radius of between 0.20 to 2.0 inches.

Another way to increase the area of the funnel defined by the respective funnel wall portions is to increase the area of one or more funnel wall portions by decreasing the width of the funnel rim 618. Since the magazine well funnel assembly fits inside the confines of the firearm frame 602, there is a limited amount of space available for the funnel portion 604 of the magazine well funnel assembly. The size and shape of the aperture formed by the funnel wall portions is likely fixed, such as in the case of a standard size magazine. Apportioning more area to the funnel wall portions and less area to the funnel rim therefore increases the area of the funnel defined by the funnel wall portions. In an implementation, the funnel rim 618 has a width of substantially 0.060 inches around an entire perimeter of the funnel rim. In another implementation, the width of the funnel rim varies along its length. In yet another implementation, the width of the funnel rim is substantially equal to or less than 0.18 inches around an entire perimeter of the funnel rim. Other widths of the funnel rim are also disclosed herein. For example, the width of the funnel rim may be substantially equal to or less than 0.46 inches around an entire perimeter of the funnel rim.

The magazine lip access notch 622 is disposed adjacent to the magazine lip support surface 620. In an implementation, the magazine lip access notch 622 includes a curved inner surface. In another implementation, the magazine lip access notch is substantially 0.055 inches deep with respect to the outer surface of the magazine well funnel assembly. In another implementation, the magazine lip access notch is approximately 0.366 inches wide. Other dimensions of the magazine lip access notch are also disclosed herein including dimensions from 0.1 to 0.0275 inches deep and from 0.732 to 0.183 inches wide.

Figure 7:
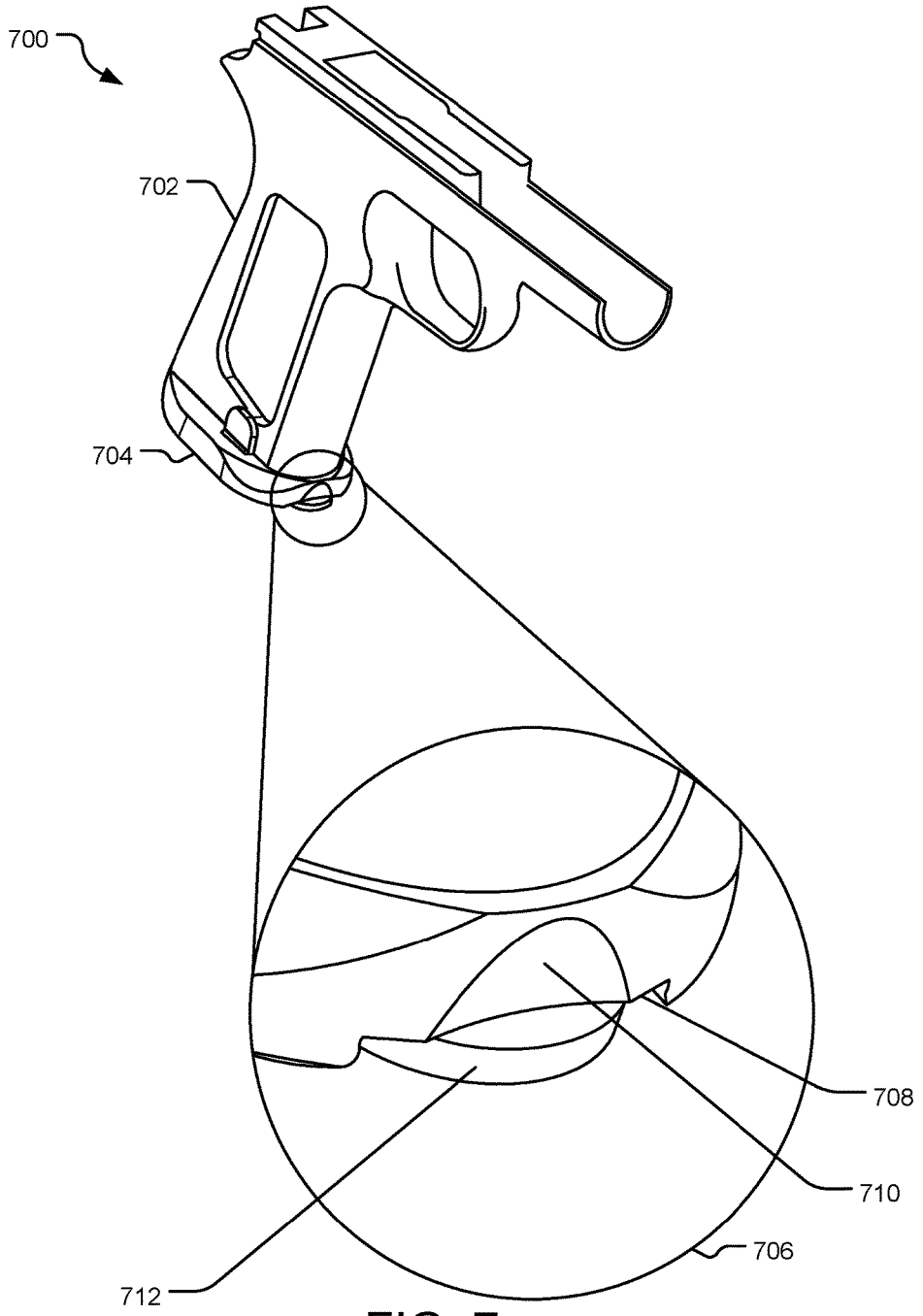
FIG. 7 is a perspective view from above showing a firearm frame with an example magazine well funnel assembly with a magazine inserted and an expanded perspective view from above of the base of a firearm frame and example magazine well funnel with a magazine inserted.

FIG. 7 is a perspective view 700 from above showing a firearm frame 702 with an example magazine well funnel assembly with a funnel portion 704 with a magazine inserted therein and an expanded perspective view 706 from above of the base of the firearm frame 702 and example magazine well funnel portion 704 with a magazine inserted.

The funnel portion 704 of the magazine well funnel assembly includes a magazine lip support surface 708 and a magazine lip access notch 710 disposed adjacent thereto. When the magazine is fully inserted into the firearm 702 via the aperture in the magazine well funnel portion 704, the lip 712 of the magazine rests against the magazine lip support surface 708. The magazine lip support surface 708 provides an additional point of contact between the magazine and the firearm 702, thus improving fit and stability of the magazine and prevents the magazine from being inserted too far inside the firearm, which could cause damage to the firearm or could cause the magazine to become stuck inside the firearm. In an implementation, the magazine lip support surface 708 is a recessed surface in a funnel rim. In another implementation, the magazine lip support surface 708 is not part of the funnel rim. For example, without limitation, the magazine lip support surface 708 may be substantially 0.070 inches below the funnel rim. In another implementation, the magazine lip support surface 708 may be disposed above the funnel rim.

The magazine lip access notch 710 is disposed adjacent to the magazine lip support surface 708. In an implementation, the magazine lip access notch 710 includes a curved inner surface. In another implementation, the magazine lip access notch is substantially 0.055 inches deep with respect to the outer surface of the magazine well funnel assembly. In another implementation, the magazine lip access notch is substantially 0.366 inches wide. Other dimensions of the magazine lip access notch are also disclosed herein including dimensions from 0.1 to 0.0275 inches deep and from 0.732 to 0.183 inches wide.

Figure 8:
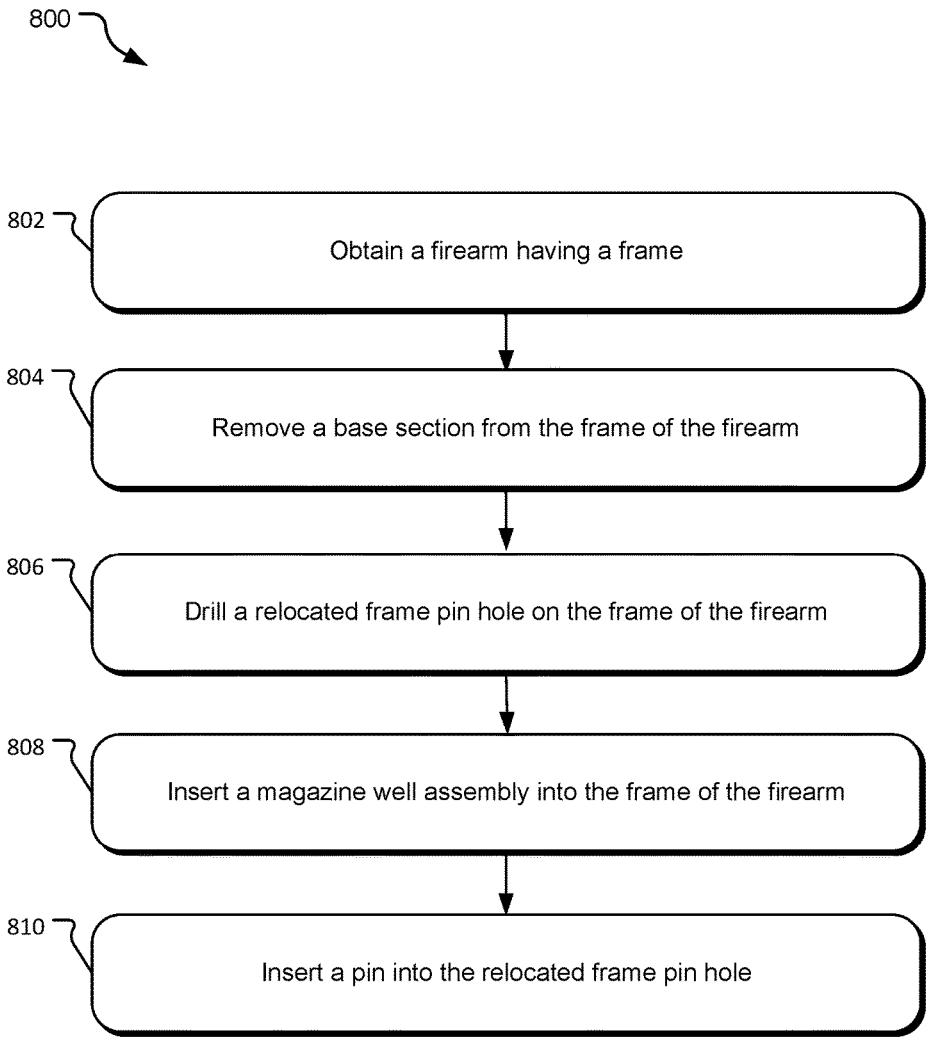
FIG. 8 illustrates a flow diagram showing example operations for modifying a firearm to incorporate a magazine well funnel assembly.

FIG. 8 illustrates a flow diagram showing example operations 800 for modifying a firearm to incorporate a magazine well funnel assembly. In some instances, installing a magazine well funnel assembly on an existing firearm will increase the vertical length of the frame of the firearm. The example operations 800 modify a firearm to accept a magazine well funnel assembly without increasing the vertical length of the combination of the modified firearm frame and installed magazine well funnel assembly compared to the unmodified firearm frame. To a shooter, it will appear that the length of a modified firearm with newly installed magazine is the same as the length of an unmodified firearm with previously installed magazine well funnel assembly (e.g., the effective length of the firearm will be preserved).

Due to the vertical size of the funnel portion of the magazine well funnel assembly, the mainspring housing portion of the magazine well funnel assembly may be shortened to maintain the same overall length of the firearm. A shorter mainspring may be needed to accommodate the shortened mainspring housing section. To maintain an adequate spring force in a shortened mainspring, the mainspring, and the cavity in the mainspring housing enclosing the mainspring, may be widened, thus preserving the actuation force on the hammer and maintaining proper operation of the firearm.

Preserving the effective vertical length of a firearm provides several advantages for shooters. One example are concealed carry application. For safety reasons, persons carrying firearms in concealed carry application must keep the firearm hidden from view, typically by carrying the firearm inside clothing such as a jacket, shirt, or blouse or in a case such as a purse, fanny pack, briefcase, etc. The larger the firearm, the more difficult it is to conceal in the typical manner. A magazine well funnel assembly installed on the end of an unmodified firearm frame would not preserve the effective vertical length of the firearm because it would extend beyond the end of the frame. The vertical length of the firearm frame, which includes the grip area of the firearm frame, is often the most difficult portion of the firearm to conceal. This portion of the firearm frame is the portion which, when carried in a belt holster, can protrude most conspicuously from underneath a garment. If a magazine well assembly adds vertical length to the firearm, it may be necessary to use a magazine base pad to ensure access to the magazine. A magazine base pad adds further to the vertical length of the firearm frame. The additional bulk and vertical length is significant enough to be unacceptable to many shooters.

Another example of an advantage for shooters of preserving the vertical length of the firearm is for storage purposes. For example, an unmodified firearm with a magazine well assembly may not fit in a case, safe, or other storage device if it is longer than a standard firearm frame. Yet another example, a shooter may be accustomed to handling a firearm with a frame of a certain length and increasing the length may interfere with the shooter's ability to handle the firearm effectively. As another example, a shooter may not wish to lengthen the firearm frame as a matter of preference.

In the operations 800, an obtaining operation 802 obtains a firearm. In an implementation, the obtaining operation 802 obtains a firearm having a frame sized to accept a standard-length magazine. In another implementation, the obtaining operation 802 includes purchasing or manufacturing a firearm with a frame sized to accept a standard-length magazine after a magazine well funnel assembly has been installed on the firearm frame.

In at least one implementation, a removing operation 804 removes a base section from the frame of a firearm. The removing operation 804 may be a part of the obtaining operation 802 or it may be a distinct operation. In at least one implementation, the removing operation 804 need not be performed if the firearm frame obtained in obtaining operation 802 is already sized to accept a standard length magazine or any other length magazine with a size that matches the interior dimensions of the firearm frame and the firearm frame will not be lengthened compared to a stock firearm frame after the magazine well funnel assembly has been installed.

The removing operation 804 may be performed by cutting a standard frame, such as an M1911 firearm frame, by an amount equal in length to the length of magazine well funnel assembly. The length of a removed portion of the firearm's frame in removing operation 804 may be chosen to be substantially equal in length to the length of the funnel to preserve the original length and width of the firearm frame after the magazine well funnel assembly has been installed. As used herein, substantially equal in length includes lengths within 0.060 inches. A magazine well funnel assembly may also be installed on any firearm frame that is appropriately sized to accept a standard length magazine when the magazine well funnel assembly has been installed. The magazine well funnel assembly, when installed, therefore does not substantially add length or width to the frame of the firearm. In other words, when the funnel portion and mainspring housing portion are inserted into the modified firearm, the firearm frame is no longer than when the firearm was configured with a square edge at the entrance to the firearm's magazine well.

In an implementation, a base section of the firearm frame measuring substantially 0.300 inches is machined or cut away in the removing operation 804 to a specific dimension and removed to produce a shortened frame. The size of the base section in removing operation 804 may vary depending on the location of the pin hole on the firearm frame. At least one implementation includes a base section large enough to partially or completely remove an existing pin hole on the firearm frame in removing operation 804. To install a magazine well funnel assembly in a shortened firearm frame, the mainspring housing body slides into a mainspring housing slot in the magazine well of the firearm frame, and the funnel portion of the magazine well funnel assembly mates with the bottom of the shortened firearm frame. This method of attachment allows a magazine well funnel assembly to be easily removed from the firearm, and replaced should it become damaged through hard use.

A drilling operation 806 drills a relocated frame pin hole on the frame of the firearm such that the frame pin hole is aligned with a pin hole on the magazine well funnel assembly. The drilling operation 806 may be performed, for example, with the aid of a drilling jig 900 described below with reference to FIG. 10.

An inserting operation 808 inserts a magazine well funnel assembly into the magazine well of the firearm. In an implementation, the magazine well funnel assembly includes side rails for sliding within the frame of the firearm. A second inserting operation 810 inserts a pin through a pin hole in the magazine well funnel assembly and into the relocated frame pin hole drilled in drilling operation 806 to secure the magazine well funnel assembly to the frame of the firearm. Due to the shortening of the firearm frame, as described above, the mainspring housing pin hole may have been removed as part of the removed base section of frame. In other implementations, a magazine well funnel assembly can be attached to the firearm through another means, such as a screw, pin, dovetail, or key/keyway interface.

Figure 9:
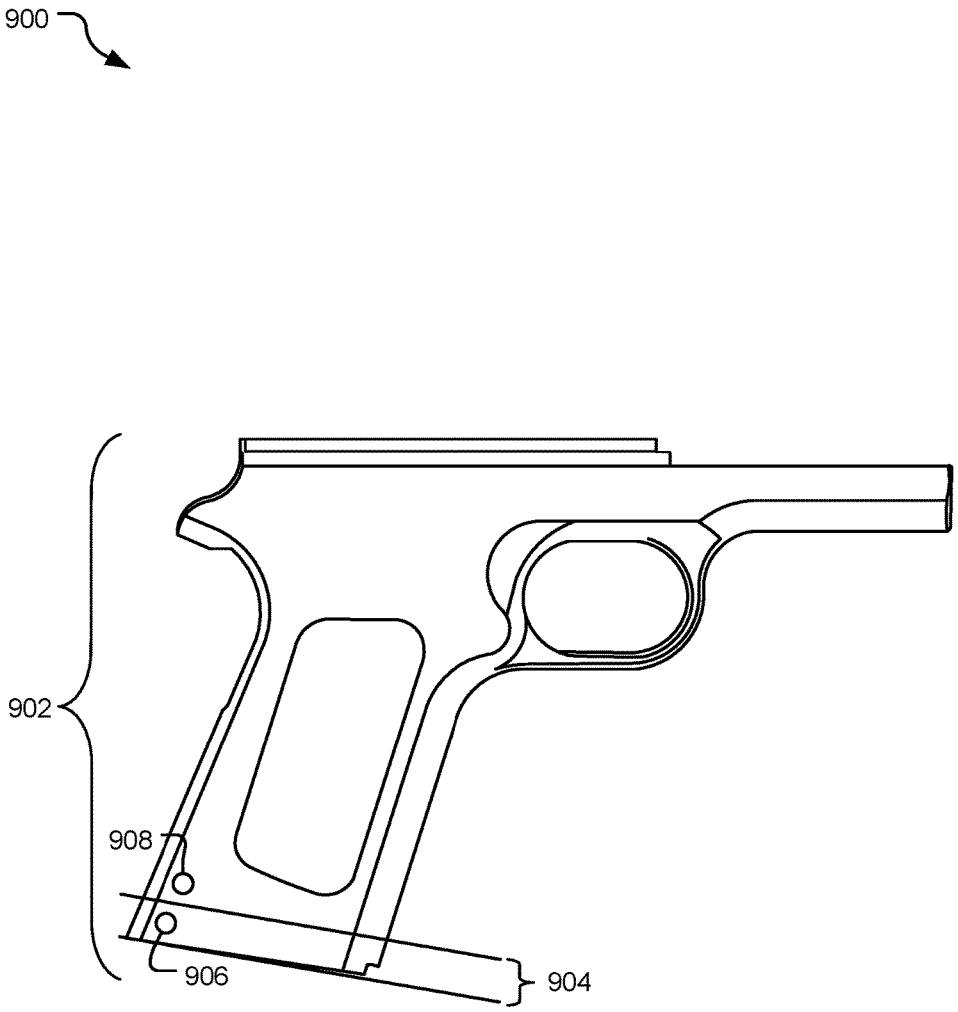
FIG. 9 is a side view of a firearm frame with a base section.

FIG. 9 is a side view of a firearm frame 900 with a base section 904. In one implementation, the base section 904 is the section of the firearm frame removed by removing operation 804 in the method 800 disclosed herein. The base section 904 may measure approximately 0.300 inches. The firearm frame 900 includes a vertical length dimension 902. The vertical length 902 of the firearm frame 900 includes the physical vertical length of the firearm when oriented as shown in FIG. 9. In an implementation, the vertical length 902 includes the firearm frame (minus a base section 904 if removed), a magazine well funnel assembly if installed, a magazine, and a magazine base pad if present, thus representing the overall effective vertical length of the firearm.

In at least one implementation, the base section 904 of the firearm frame 900 includes a frame pin hole 906. If the base section 904 is removed from the firearm frame 900, then a magazine well funnel assembly may not be able to attach to the firearm frame 900 via the frame pin hole 906 because it has been removed. To attach a magazine well funnel assembly to the frame 900, a relocated frame pin hole 908 is located on the firearm frame 900. The relocated frame pin hole 908 may be formed by drilling or another suitable process depending on the material of firearm frame 900.

Figure 10:
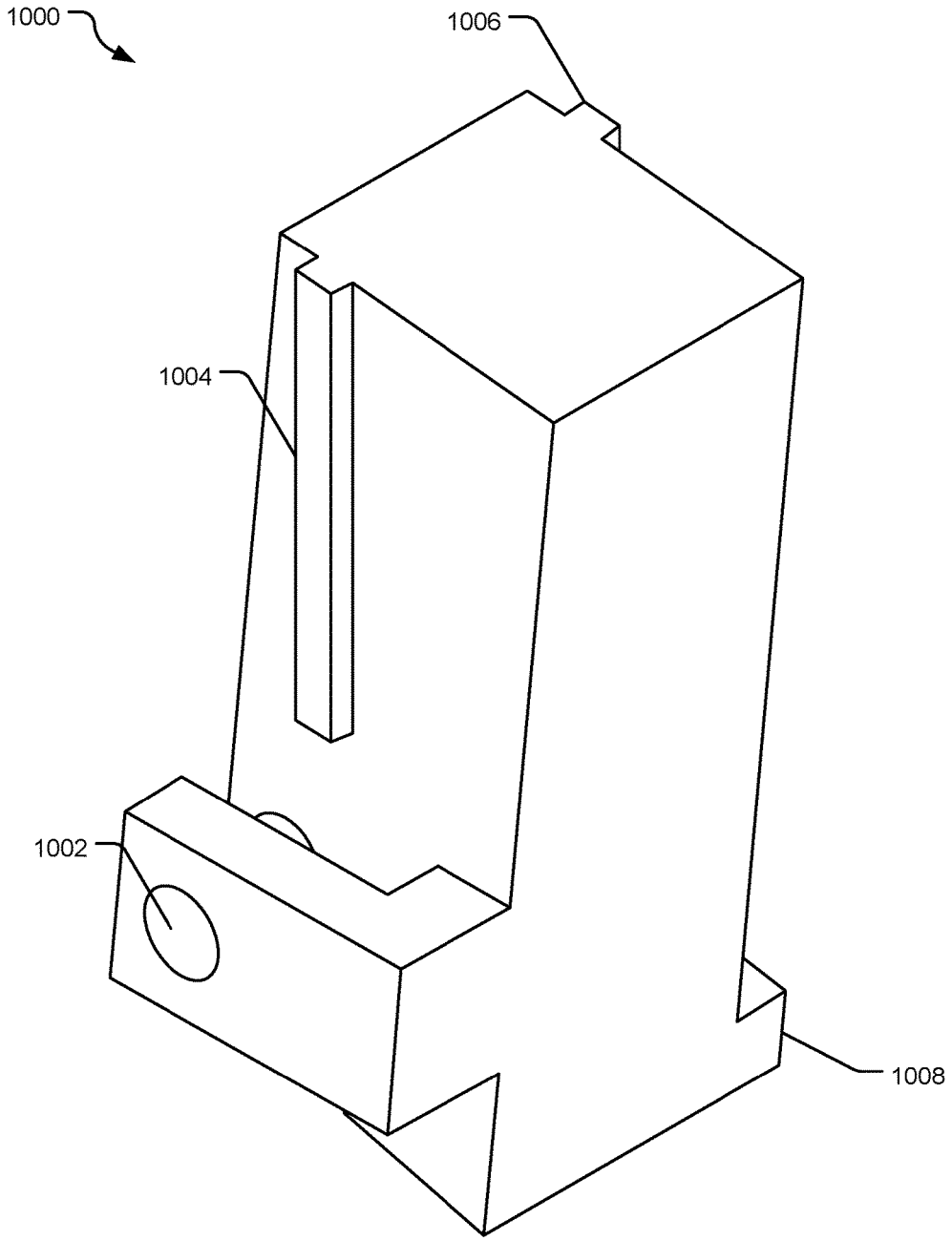
FIG. 10 is a perspective view of a firearm frame pin hole drilling alignment jig from the left.

FIG. 10 is a perspective view of a firearm frame pin hole drilling alignment jig 1000 from the left. The firearm frame pin hole drilling alignment jig 1000 includes a member slidably insertable onto the frame of a firearm into a relocating position. The jig 1000 slides within the firearm frame on side rails 1004 and 1006. In an implementation, the jig 1000 includes a locating ledge 1008 to prevent the jig 1000 from sliding too far inside the firearm frame. When the locating ledge 1008 is in contact with the firearm frame, the realignment jig 1000 is referred to herein as being in a hole relocating position.

When the jig 1000 is in the relocating position, alignment hole 1002 is aligned with the location of a new pin hole to be drilled after a base section has been removed from the base of the frame of the firearm. In an implementation, the jig 1000 may be used to locate the frame pin hole in the drilling step in the method 800 due to the removal of a frame pin hole as part of a removed base section of the firearm frame, which would no longer be available for securing the magazine well funnel assembly to the firearm frame. Drilling through the alignment hole 1002 on the jig 1000, and into the firearm frame, will produce a relocated pin hole in the firearm frame that matches the position of the pin hole on the shortened mainspring housing of the magazine well funnel assembly. The integrated magazine well funnel and mainspring housing may therefore be secured to the firearm frame using a pin through the relocated pin hole and the pin hole on the mainspring housing.

In another implementation, the magazine well funnel assembly may be manufactured so that the front of the funnel portion is open, rather than having a continuous contour. To fit a magazine well funnel assembly with an open front portion to a shortened frame, the frame would be machined in such a way as to leave a portion of the frame still intact. The portion left intact includes the portion of the frame which limits the upward travel of the magazine as it is inserted into the firearm. The sides of the magazine funnel mate with the side of the portion of the frame still left intact.

In some implementations, the magazine well funnel assembly is configured to accept an ammunition magazine for a firearm, but other types of non-firearm magazines may also be used with the magazine well funnel assembly. For example, without limitation, the magazine well funnel assembly may be used with various types of guns (e.g., a staple gun, a nail gun, a paintball gun, etc.) or in a machine or device that accepts input material in the form of a magazine (glue pellets, optical film, magnetic or adhesive tape, ink, computer memory, solid fuel, a powder, etc.). As used herein, the term magazine may encompass any physical enclosure designed to deliver a discrete payload to a device, such as a cartridge, a cassette, cylinders, tubes, etc.

In implementations described herein, the magazine well funnel assembly may be fabricated out of the following materials: Carbon Steel, Alloy Steel, Stainless Steel, Aluminum, Titanium, Plastic, and/or Delrin. Manufacturing methods including machined from barstock, investment casting, forging, metal injection molding, plastic injection molding, and/or additive manufacturing (3D printing) may be used. The magazine well funnel and integrated mainspring housing may be sized to match grips made to a thinner dimension. The surface texturing may include smooth, checkered, or other functional or ornamental designs cut into surface. Surface plating may include blued finish, satin matte finish, cerakote, hard chrome, nickel plated, polymer, teflon, and/or moly coated. The magazine well funnel assembly may include: larger or smaller reinforcement tabs, a larger or smaller funnel portion, a larger or smaller magazine access notch. Suitable firearm frames for modification include all M1911 pattern firearms, and any other firearm utilizing a mainspring housing type component which can be used to attach the magazine well funnel assembly, or any firearm that accepts magazine-loaded ammunition.

What is claimed is:

1. A method of modifying a firearm comprising:

obtaining a firearm having a frame, the frame having a first frame pin hole;

removing a base section from the frame of the firearm, the base section including the first frame pin hole;

drilling a relocated frame pin hole on the frame of the firearm inserting;

a magazine well funnel assembly into the frame of the firearm, wherein the magazine well funnel assembly includes a mainspring housing body and a magazine well funnel portion integrated with the mainspring housing body, the mainspring housing body further having a mainspring housing body pin hole and the magazine well funnel portion having a set of funnel walls arranged to form an aperture shaped to accept a magazine; and inserting a pin into the relocated frame pin hole and the mainspring housing body pin hole.

2. The method of claim 1, wherein the base section has a length substantially equal to the length of a funnel portion of the magazine well funnel assembly.

3. The method of claim 1, further comprising:

machining one or more of the walls in the set of funnel walls such that the one or more of the walls in the set of funnel walls has a substantially flat upper portion adjacent to a funnel rim and a sloping lower portion adjacent to the aperture.

4. The method of claim 1, wherein the vertical length of the firearm is substantially the same after the inserting operation as before the removing operation.

5. The method of claim 1, wherein the frame is sized to accept a magazine after the removing operation and after the operation inserting the magazine well funnel assembly into the frame, the magazine having a length of approximately 4.625 inches.

* * * * *